US005713511A

United States Patent [19]

Diamond

[11] Patent Number: 5,713,511

[45] Date of Patent: Feb. 3, 1998

+

[54] MULTI-PURPOSE ENVELOPE

[76] Inventor: Elliott H. Diamond, P.O. Box 2024, Reston, Va. 22090-0024

[21] Appl. No.: 570,204

[22] Filed: Dec. 11, 1995

Related U.S. Application Data

[63] Continuation of Ser. No. 441,303, May 15, 1995, abandoned, which is a continuation-in-part of Ser. No. 181,966, Jan. 18, 1994, Pat. No. 5,415,341, which is a continuation of Ser. No. 886,093, May 21, 1992, abandoned.

[51] Int. Cl.[6] ..... B65D 27/06

[52] U.S. Cl. ..... 229/302; 229/305

[58] Field of Search ..... 229/302, 303, 229/305, 306, 80, 80.5; 383/84, 85, 86.1

[56] References Cited

U.S. PATENT DOCUMENTS

| | | | |
|---|---|---|---|
| 886,449 | 5/1908 | West . | |
| 1,064,302 | 6/1913 | Donohue . | |
| 1,091,172 | 3/1914 | Thayer . | |
| 1,164,606 | 12/1915 | Wittmann . | |
| 1,575,769 | 3/1926 | Kaye | 229/306 X |
| 2,153,504 | 4/1939 | Didier . | |
| 2,317,335 | 4/1943 | Whitman . | |
| 2,350,100 | 5/1944 | Deutschmeister et al. . | |
| 2,686,005 | 8/1954 | Hyman . | |
| 2,907,514 | 10/1959 | Bermingham et al. . | |
| 2,931,559 | 4/1960 | Hilliard . | |
| 3,197,121 | 7/1965 | Hayes, Jr. | 229/305 X |
| 3,227,360 | 1/1966 | Krueger . | |
| 3,270,948 | 9/1966 | Donovan . | |
| 3,356,285 | 12/1967 | Greason . | |
| 3,512,702 | 5/1970 | Pritchard . | |
| 3,693,869 | 9/1972 | Eaves, Jr. . | |
| 3,791,572 | 2/1974 | Gendron . | |
| 3,802,618 | 4/1974 | Weissner . | |
| 3,970,242 | 7/1976 | Swafford et al. . | |
| 4,192,448 | 3/1980 | Porth | 229/80 |
| 4,278,199 | 7/1981 | Tanaka . | |
| 4,288,028 | 9/1981 | Diaz | 229/302 |
| 4,308,987 | 1/1982 | Solomon . | |
| 4,332,346 | 6/1982 | Kronman . | |
| 4,334,618 | 6/1982 | Buescher . | |
| 4,382,539 | 5/1983 | Kronman . | |
| 4,403,696 | 9/1983 | Newell . | |
| 4,436,202 | 3/1984 | Berkeley . | |
| 4,445,635 | 5/1984 | Barr . | |
| 4,565,317 | 1/1986 | Kranz . | |

(List continued on next page.)

FOREIGN PATENT DOCUMENTS

| | | | |
|---|---|---|---|
| 157628 | 9/1952 | Australia . | |
| 207982 | 12/1956 | Australia | 229/302 |
| 25 08 746 | 9/1976 | Germany . | |
| 27 06 507 | 8/1978 | Germany . | |
| 28 05 734 | 8/1979 | Germany . | |
| 3058 | of 1912 | United Kingdom . | |

*Primary Examiner*—Jes F. Pascua

[57] ABSTRACT

An envelope having two flaps, a front flap and back flap extending respectively from the front and back walls of the envelope pocket. The back flap has approximately the same vertical dimension as the envelope pocket. A set of three scrolling panels are defined on the back flap by fold lines between them. The distal panel has adhesive on its inner face and the proximal panel has a set of apertures that correspond to a set of apertures on the front flap through which the adhesive on the distal panel is wetted for sealing the scrolling back flap into engagement with the front of the envelope pocket. The front flap parks in a forward position until it is ready for use and provides a window (apertures) through which adhesive sealing of the back flap distal panel is made to the envelope pocket. This configuration permits a first mailing of this envelope structure which accomplishes the tasks of a conventional two-way envelope. The envelope also functions as a multi-path or multi-purpose envelope in that when it is sent to a recipient as an enclosure in another mail package, such as is often used in reply mail solicitations and in collecting bills, the recipient has available at least two mutually exclusive addressing schemes for mailing the inventive envelope.

4 Claims, 7 Drawing Sheets

U.S. PATENT DOCUMENTS

| | | | |
|---|---|---|---|
| 4,715,531 | 12/1987 | Stewart et al. . | |
| 4,729,507 | 3/1988 | Kim . | |
| 4,730,768 | 3/1988 | Gendron . | |
| 4,778,101 | 10/1988 | Paquin . | |
| 4,993,624 | 2/1991 | Schlich . | |
| 5,025,980 | 6/1991 | Blackman . | |
| 5,197,663 | 3/1993 | Stude . | |
| 5,207,373 | 5/1993 | Tighe . | |
| 5,224,647 | 7/1993 | Yanow . | |
| 5,400,957 | 3/1995 | Stude | 229/302 |
| 5,415,341 | 5/1995 | Diamond | 229/302 X |
| 5,516,040 | 5/1996 | Lin | 229/302 |

FIG. 2
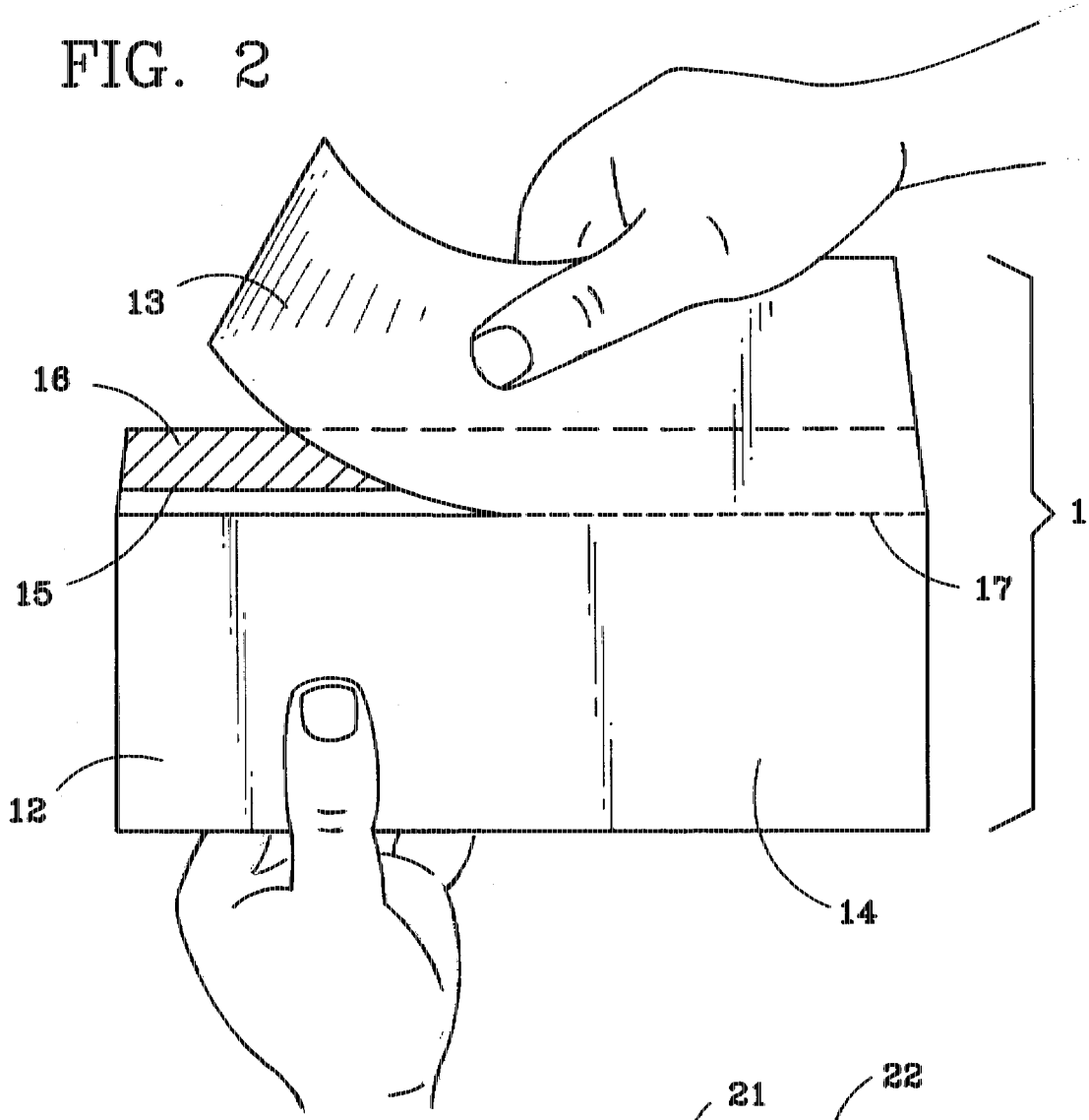
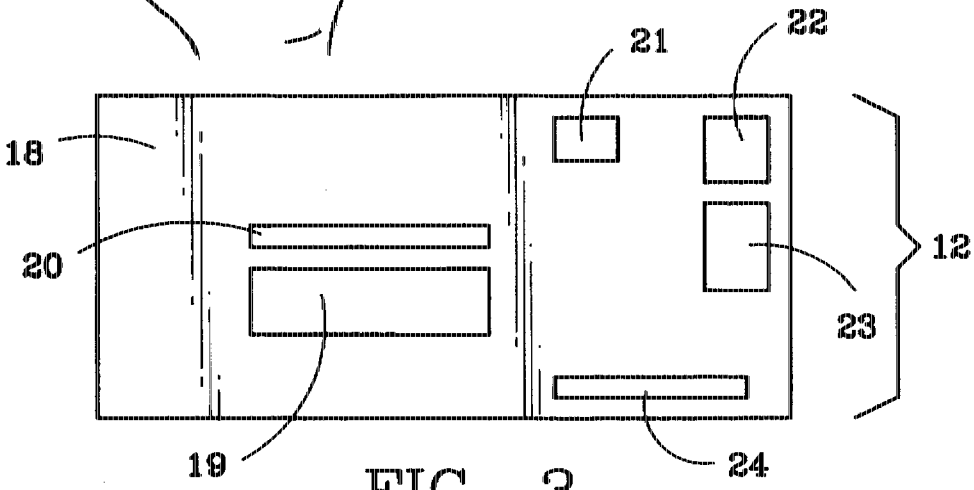
FIG. 3

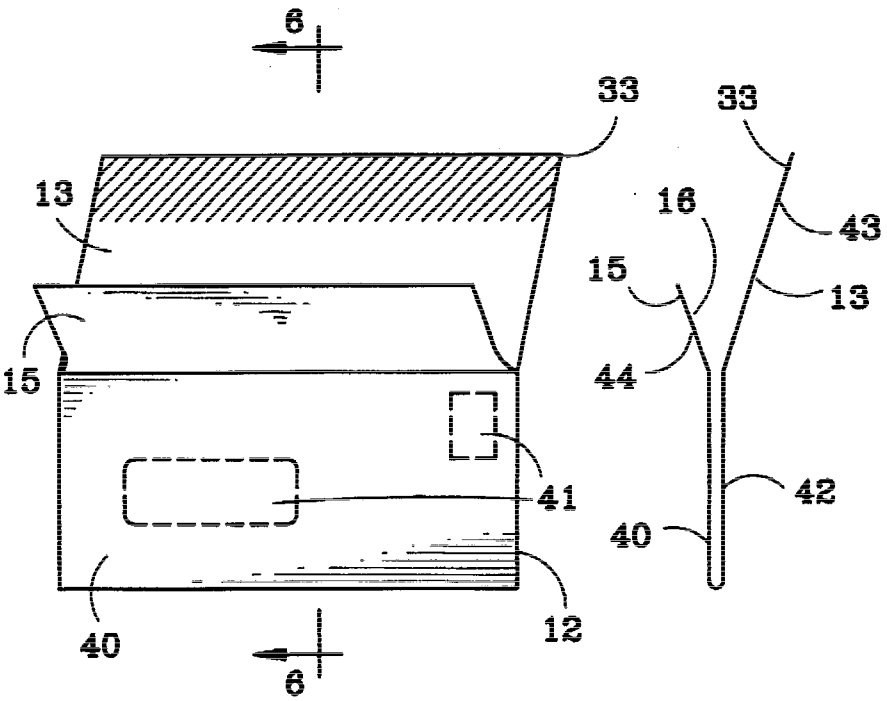
FIG. 6
FIG. 5
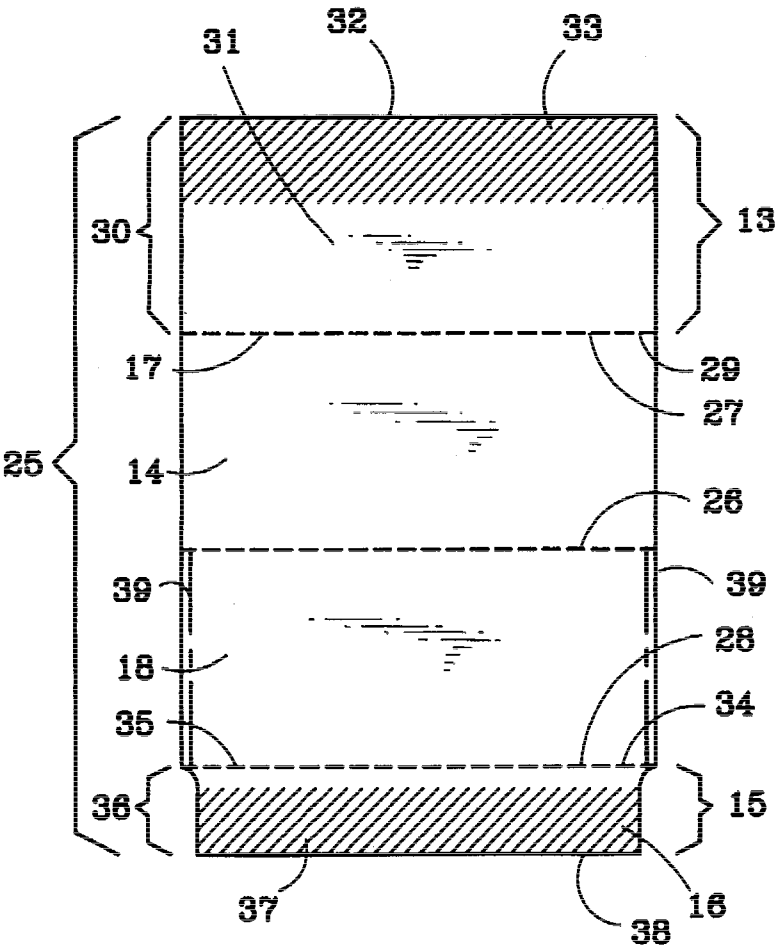
FIG. 4

MULTI-PURPOSE ENVELOPE

This application is a continuation of application Ser. No. 08/441,303, filed May 15, 1995, now abandoned, which is a continuation-in-part of application Ser. No. 08/181,966, filed Jan. 18, 1994, now U.S. Pat. No. 5,415,341, which is a continuation of application Ser. No. 886,093, filed May 21, 1992, now abandoned.

BACKGROUND OF THE INVENTION

This invention relates to novel envelopes that have the unifying characteristic of providing an addressor with at least two mutually exclusive address field sets and provide both a two-way feature and multi-destination feature in the same structure. A multi-panel flap having a unique scroll folding arrangement that is sealed to the envelope body or to a post card body through a set of apertures in one panel of the scroll-folded flap.

Conventional two-way envelopes, for which there are a plethora of examples available in the prior art, have a two-path traverse of the mailing system: first an addressor prepares and sends a two-way envelope to a recipient or addressee. Then, the recipient takes the envelope from the mail box and unseals the envelope often by tearing or ripping open along designated perforations. The term two-way means that the there is an outbound destination (addressee) at which a recipient typically performs a refolding and resealing operation; then a re-mailing of the envelope to a second or sequential addressee follows. That is to say, essentially the same physical envelope exterior materials travel through the postal system two times; thus the term two-way.

A prototypical two-way envelope uses two-flaps extending from the same side of an envelope pocket so as to allow a recipient of the first mailing to send the envelope onto a second destination. A big flap is attached to the back wall of the envelope pocket, and a small more conventionally shaped flap attaches to the pocket front wall. In other words, the small flap and envelope pocket alone look very much like a conventional envelope; the modification is simply the attachment of a large back flap that, when folded forward, both covers the small flap and the whole front panel of the envelope. By folding the small flap forward this small flap is effectively parked in an unconventional bent forward fashion for use in a later mailing. The large back flap is folded forward and glued to the front panel of the envelope along a narrow strip near the end edge. Thus the back flap becomes attached to the bottom front of the envelope pocket. The first address, sometimes called the addressee, meaning the party to whom the envelope first is sent, is then written onto the out facing surface of the big flap. When the recipient retrieves the mail piece the next step is to open it carefully so that the envelope and flap structure is preserved sufficiently for re-use. Here the large flap is torn away from the front of the envelope pocket. The flap is torn from its two anchor lines, one at the top edge of the envelope pocket back wall and the other along a perforation line adjacent to the permanently glued strip along the bottom front of the envelope pocket. The glued strip remains with the envelope pocket and the big flap is tossed away as trash. This leaves the recipient with a useable envelope, that is to say the small conventional flap can be lifted from it forward parked position and folded onto the pocket back wall to make a second construction suitable for a remailing. To make the second mailing possible, the second sender (first recipient) writes a second address (second addressee) on the front panel of the pocket, attaches postage and drops the reconfigured envelope into the mail.

Here the required sequence of events presents the first recipient with a damaged area on which is left a selvage strip that makes for an uneven writing surface.

The present invention resides in an entirely different genre of envelope art in that no two-way envelope, by definition, allows the selection of either a first or second address for the first destination of an ordinary envelope by using flaps provided on the envelope. For example the usefulness of such an arrangement is apparent when a person needs to send a payment to a first address by a given date such as for the payment of a bill, and to a second address if the payment is late. In such a situation it behooves the user to have available both alternative addresses on the same pre-printed envelope. Likewise, those charitable organizations that wish to make available to contributors a posting arrangement that will save postage expense for the organization need a way to bypass the Business Reply Mail procedure. Thus there is a need for an envelope that allows the contributor to substitute an addressing arrangement for which the contributor supplies postage by affixing a conventional stomp or a meter marking.

Such a choice of multiple destination addresses on one envelope provides for a mailing instrument that is designed to traverse the mailing system once with its exterior surfaces exposed. This is distinguished from a so-called two-way envelope that has its exterior surfaces exposed for two traverses. A multi-purpose envelope, in contrast, provides multiple paths for traversing the postal system; the paths being selectable by the user when preparing the envelope for mailing.

Another problem appears in the manufacture or fabrication of envelopes requiring two flaps both of which need to have a quiescent adhesive applied to opposing faces. Commonly used folding machines and web presses do not have the ready capability to place two adhesive fields on two flaps of one envelope.

Many present day postal patrons are inundated with mass mailings in which a reply envelope is enclosed for a response to be mailed back to the sender. The reply envelope is usually a so-called Business Reply Envelope (BRE) which has an entirely pre-printed front face that meets postal regulations to allow the reply envelope to traverse the postal system in a kind of cash on delivery (COD) arrangement whereby the reply mail permit holder pays postage when the reply is picked up at a post office. Many of these BRE instruments are discarded into the trash cans of the initial recipients; thus representing a waste of natural resources and promoting irresponsible ecological behavior. These discarded BRE's are not readily useable for mailing to an address other than the one pre-printed on the pocket face. To have another use for that envelope as a mailing instrument would be advantageous.

The difficulties and deficiencies suggested by the preceding paragraphs are not intended to be exhaustive but rather are among many which may tend to reduce the effectiveness of prior envelopes and their associated mailing arrangements. Other noteworthy problems may also exist; however, those presented above should be sufficient to demonstrate that envelopes appearing in the past will admit to improvement.

OBJECTS THE INVENTION

It is therefore a general object of the invention to provide a novel method of executing a mailing using a multipurpose, mailing instrument using available multiple addressing schemes.

It is a specific object of the invention to provide a novel envelope or mailing instrument having at least two mutually exclusive addressee field sets available to the addressor.

It is another object of the invention to provide a novel envelope or mailing instrument having a user configurable flap folding arrangement that allows the envelope to travel on at least two different transit paths to desirable destinations.

It is still another object of the invention to provide a novel arrangement of various dormant or nascent postage and address fields that are selectable for activation by a user.

It is a further object of the invention to provide a novel single sheet stock envelope having structural features that allow for manufacturing, fabrication an application of adhesive regions using readily available commercial envelope making machines.

It is yet a further object of the invention to provide a novel envelope structure and method of executing a mailing that conforms to postal regulations and to user requirements for simplicity.

It is still a further object of the invention to provide a novel envelope arrangement to industry and the consumer that allows the end user to convert the envelope to personal use while initially presenting the consumer with a pre-prepared return envelope.

It is yet another object of the invention to provide a novel mailing instrument that offers an alternative postage field set so that a user is allowed to substitute a postage stamp or meter indicia for printed Business Reply Envelope without the Post Office registering a business reply mail postage charge against the addressee.

It is still yet another object to provide a novel mailing instrument that allows one flap and one adhesive field to provide both a two-way single purpose envelope and a one-way double purpose envelope.

It is yet still a further object to provide a novel mailing instrument that allows a two-flap, two-adhesive field arrangement to produce a two-way, double purpose envelope.

BRIEF SUMMARY OF A PREFERRED EMBODIMENT OF THE INVENTION

A preferred embodiment of the invention which is intended to accomplish at least some of the foregoing objects comprises an envelope pocket having two flaps, a front flap and back flap extending respectively from the front and back walls of the envelope pocket. The back flap has approximately the same vertical dimension as the envelope pocket. A set of three scrolling panels are defined on the back flap by fold lines between them. The distal panel has adhesive on its inner face and the proximal panel has a set of apertures that correspond to a set of apertures on the front flap through which the adhesive on the distal panel is wetted for sealing the scrolling back flap into engagement with the front of the envelope pocket. The front flap parks in a forward position until it is ready for use and provides a window (apertures) through which adhesive sealing of the back flap distal panel is made to the envelope pocket. This configuration permits a first mailing of this envelope structure which accomplishes the tasks of a conventional two-way envelope. At the first destination the scroll is unfurled or unrolled and thereby presents the recipient with a choice of either a pre-addressed response envelope or an envelope having another address scheme available for use. The other address scheme becomes available by tearing off the scroll flap and using the small front flap to seal the pocket for the next posting.

The inventive envelope also functions as a multi-path or multi-purpose envelope in that when it is sent to a recipient as an enclosure in another mail package, such as is often used in reply mail solicitations and bill collection, the recipient has available at least two mutually exclusive addressing schemes that can be used for mailing the inventive envelope. One of these choices is to roll the scroll flap arrangement into a mailing configuration thereby using the lower part of the envelope pocket as part of an addressing scheme and combining that with the exposed middle scroll panel to define an address scheme. Another choice is to use the flap in the unfurled condition and attach it to the lower front of the envelope pocket with the adhesive on the distal scroll panel. Yet another choice is to tear off the back scroll flap and employ the small front flap for sealing the envelope pocket.

BRIEF DESCRIPTION OF THE DRAWINGS

Other objects and advantages of the present invention will become apparent from the following detailed description of the preferred embodiment taken in conjunction with the accompanying drawings wherein:

FIG. 2 is a view of the rear or the designated back facial plane of the present invention which shows the animated removal of the large flap at a fold line joining the flap to the envelope back.

FIG. 3 is a front facial view of the inventive envelope which depicts the various components of the postage and address fields that are designated on the inventive mailing instrument.

FIG. 4 is an interior view of an unfolded blank form from which a first embodiment of the envelope mailing instrument of the present invention is produced.

FIG. 5 is an exterior frontal view of the inventive envelope assembled with the sides closed to form envelope pocket and having flaps extending from the both the front and back walls.

FIG. 6 is a section view taken at location 6—6 of the assembled envelope shown in FIG. 5.

DETAILED DESCRIPTION

Context of the Invention

Figure 1:
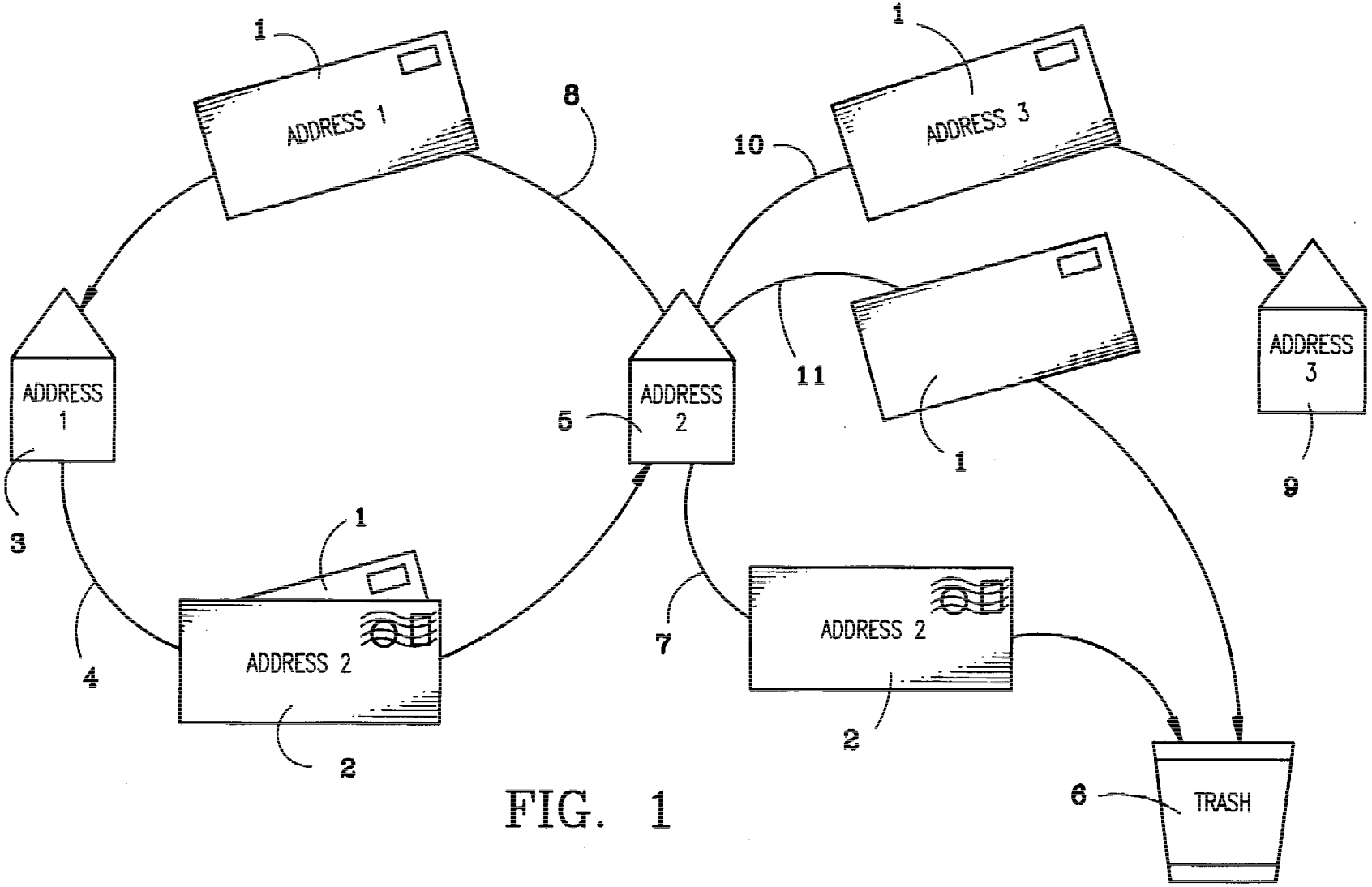
FIG. 1 is a state chart showing the flow paths and events associated with the present invention of a multi-purpose reply envelope.

Before discussing in detail a preferred embodiment of the subject multi-purpose envelope, it may be useful to outline an operative environment for the invention. Referring to the drawings, wherein like numerals indicate like parts, and initially to FIG. 1 there will be seen an operative context of the invention. In this connection, a flow or state diagram shown in FIG. 1 presents an abstract tool for visualization of the paths a mailing intrument traverses in the postal system. Here the inventive multi-purpose envelope 1 is shown travelling inside a larger carrier envelope 2 from a first address 3 over a first path 4 to a second address 5 where the carrier envelope 2 is discarded into a trash can 6 shown by a trash path line 7. The recipient at the second address 5 has an optional set of actions available with regard to what use can be made of the multi-purpose envelope 1. One choice is to send the envelope back to the first address 3 which appears printed on the front of the multi-purpose envelope 1 shown as a second mailing path line 8. Another choice is to send the multi-purpose envelope to a third address 9 shown as a third mailing path line 10. Of course, the recipient can also throw the multi-purpose envelope 1 into the trash can 6 shown as a second trash path line 11.

In FIG. 2 there is shown one method for selecting an alternative address for the inventive multi-pupose envelope 1 which has a conventional main pocket 12 closed on three of its four sides and open on top; this pocket may be referred to hereinafter as a mailing instrument body. In FIG. 2 a large back flap 13 extends from the back wall 14 of the pocket and a smaller conventional front flap 15 extends from the front wall (not shown in FIG. 2). A conventional adhesive strip 16 resides on the front flap 15. FIG. 2 depicts the removal of the large back flap 13 along a crease or fold line 17 in the envelope stock material that allows the back flap 13 to hinge and fold forward to cover the front of the envelope. This fold line 17 defines a tear line for removal of the large back flap. In simple terms, the choice of whether the use the large flap 13 or to remove it enables the user to choose among two available addressing schemes to permit the envelope to traverse a second mailing path 8 or a third mailing path 10.

The detailed structure and advantages of this novel multipurpose envelope will be discussed in detail below.

Multi-purpose Envelope

Turning now to FIG. 3, a front face 18 of a mailing instrument body or envelope pocket 12 shows a set of nascent postal fields which are standard postal fields that may be activated as a whole group or a subset based on the user's discretion. The postal fields depicted in FIG. 3 are those that would customarily appear on the face of Business Reply Mail (BRM) and include addressee 19, a postal field for BRM 20, a postal FIM code for certain classes of mail 21, postage field 22, postal bar-code field for BRM 23, and postal bar-coded field for zip codes 24. Hereinafter the outer front wall or front face 18 may be referred to as the front facial plane. In the figures and description that follows only partial postal field sets appear but the field set is defined to be any customarily required field or a desirable field for passage of a mailing instrument through the postal system. Postal fields, when used according to well established postal practices, have the inherent capability to transform an ordinary envelope which has only the capability of enclosing an article, such as a letter, into a mailing instrument that carries postal instructions and meets other regulations to make it an instrument in both the legal sense of the word and in the implemental sense.

In FIGS. 4–6 an unfolded envelope blank is shown followed by a folded arrangement and a cross section illustrating the flap structure. A single sheet of stock material 25 such as paper, plastic or any available material from which envelopes are conventionally fabricated is prepared by die cutting or whatever other conventional means are normally employed. As viewed in FIG. 4 the inner surfaces of the envelope are presented. A front facial plane terminal edge 28 defines one of the vertical boundaries of the front facial plane 18; a back facial plane terminal edge 27 defines one of the vertical boundaries of the back facial plane 14. The other boundaries of the front and back facial planes 18 & 14 are defined by a pocket fold line 26 resident between the front facial plane 18 and the back facial plane 14; the pocket fold line 26 is located approximately midway between the terminal edges 27 & 28. The large back flap 13 now designated as the back depending hinged planar element has a terminal edge 29 that defines one limit of its vertical dimension and this terminal edge joins the back facial plane terminal edge 27 at the fold line 17 between the back flap 13 and the back wall 14; this separation line known is also known as the first separable line of definition 17. As viewed from FIG. 4 the inner face 30 of the back depending hinged planar element is shown toward the viewer; this face is also known as the first ventral surface 31. The term of art "ventral surface" finds support for usage in botany to refer to the lower face of a leaf. The vertically opposite terminal edge 32 of the back depending hinged planar element is defined to be spaced from the first separable line of definition 17 approximately the same distance that the pocket fold line 26 is from the back facial plane terminal edge 27. A narrow adhesive band 33 resides along the longitudinal dimension of the first ventral surface at a location near the vertically opposite terminal edge 32.

A similar but shorter flap resides on the opposite end of the envelope blank. The shorter flap 15 is known as the front depending hinged planar element and has a terminal edge 34 that defines one limit of its vertical dimension; this terminal edge joins the front facial plane terminal edge 28 at line known as the second separable line of definition 35 which is also a fold line. As viewed from FIG. 4, the inner face 36 of the front depending hinged planar element is shown toward the viewer; this face is also known as the second ventral surface 37. The vertically opposite terminal edge 38 of the front depending hinged planar element is defined to be spaced from the second separable line of definition approximately the length of a conventional envelope's front flap. A narrow adhesive band 16 known as the second adhesive field resides along the longitudinal dimension of the second ventral surface at a location near the vertically opposite terminal edge 38.

A sealing line 39 traverses the side edges of the inner surfaces of the front facial plane; this is representational of the means for joining the envelope back and front pieces to form the pocket 12 which is closed on three of the four available sides. The constructed pocket 12, FIG. 5 presents the outer surface 40 of the front envelope wall or front facial plane which is available to carry a set of first defined nascent postal fields 41 for use in effecting the conversion of the envelope into a mailing instrument. Both the back flap 13 and the front flap 15 are shown extending from the open side of the pocket 12 in an unfolded or un-parked condition. Turning to FIG. 6, the cross sectional view shows the outer surface 40 of the front facial plane and the outer surface 42 of the back facial plane facing in opposite directions. The out facing surface 43 of the back flap 13 which faces out or away from the interior of the envelope pocket is defined as the first facial surface and can be thought of as a continuation of the outer surface of the back wall of the envelope pocket. The first facial surface 43 is on the opposite side of the large flap wall 13 from the first ventral surface 31.

Now viewing the envelope from the front as shown in FIG. 5 and further elucidated in FIG. 6, the out facing surface 44 of the front flap 15 which faces out or away from the interior of the envelope pocket is defined as the second facial surface and can be thought of as a continuation of the outer surface of the front wall of the envelope pocket. The second facial surface 44 is on the opposite side of the small flap wall 15 from the second ventral surface 37.

Figure 8:
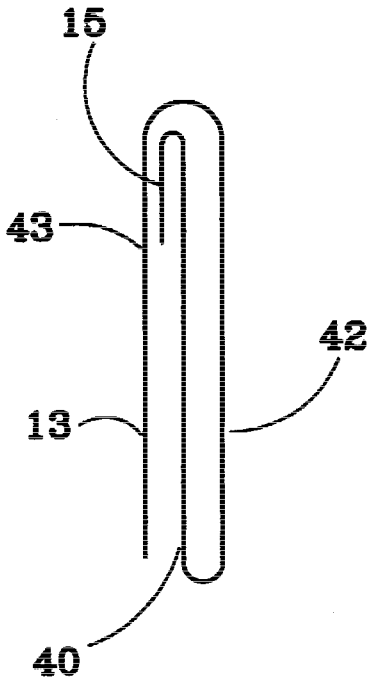
FIG. 8 is a section view taken at location 8—8 of the assembled envelope shown in FIG. 7.
Figure 7:
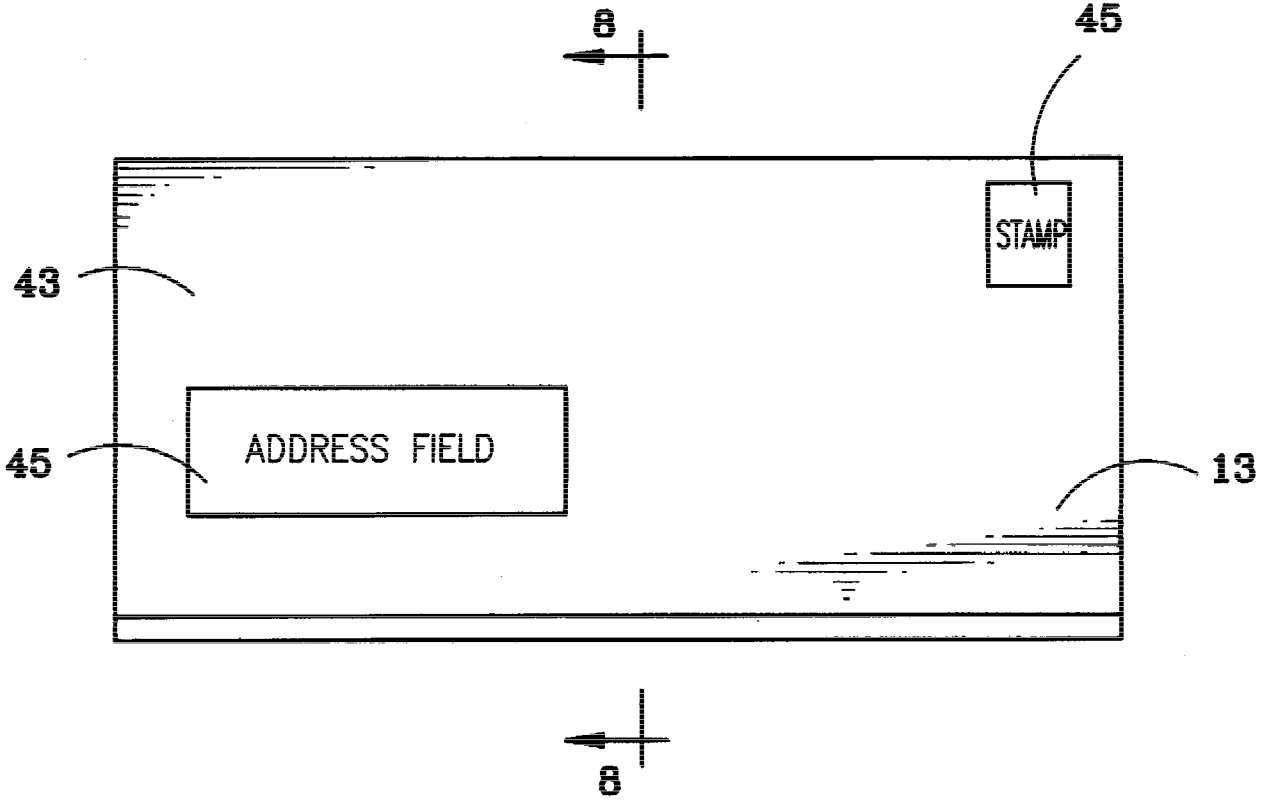
FIG. 7 is a frontal view of the first embodiment of the inventive envelope with the large flap folded over the front of the envelope pocket.

Turning to FIG. 7 the inventive mailing instrument appears with the large back flap 13 folded forward to cover almost all of the outer surface 40 of the front facial plane. A set of second defined nascent postal fields 45 reside on the first facial surface 43. FIG. 8 shows the indicated cross section of the folded instrument with the small front flap 15 in a forward parked position. Here the parked position refers to a flap condition that is other than the flap,s primary or final functional position, i.e., a folded position for a flap indicates that this is the final or primary use for that flap; a parked position indicates that the flap is stored in a waiting position and retains full functionality.

Figure 11:
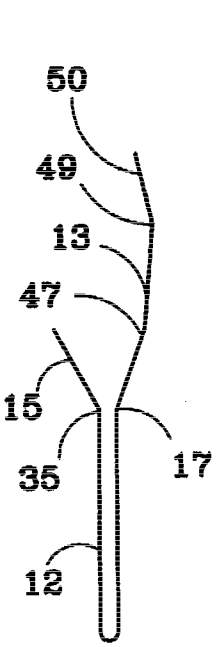
FIG. 11 is a section view taken at location 11—11 of the assembled envelope shown in FIG. 10.
Figure 10:
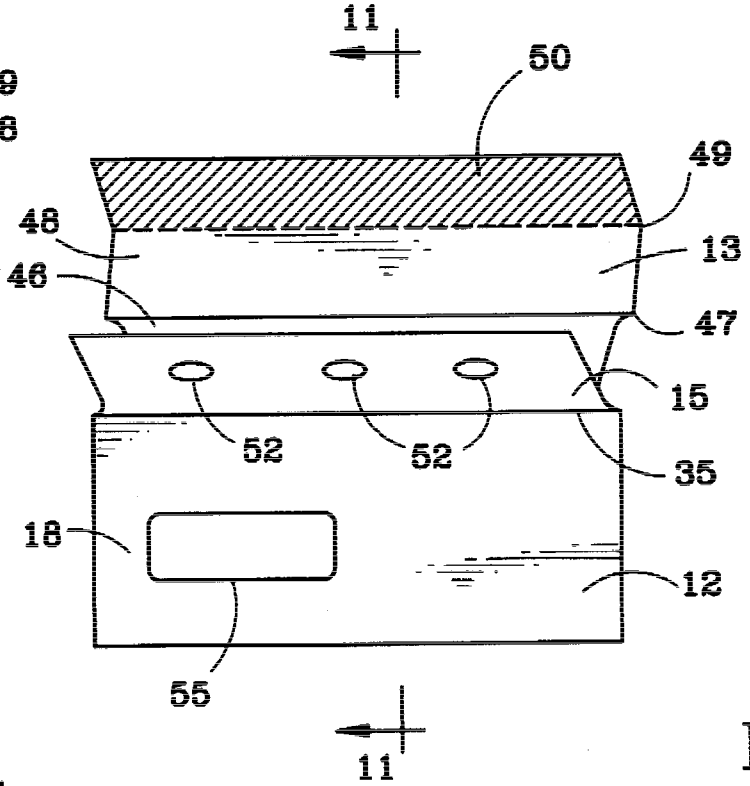
FIG. 10 is an exterior frontal view of the second embodiment of the inventive envelope assembled with the sides closed to form envelope pocket and having flaps extending from the both the front and back walls.
Figure 9:
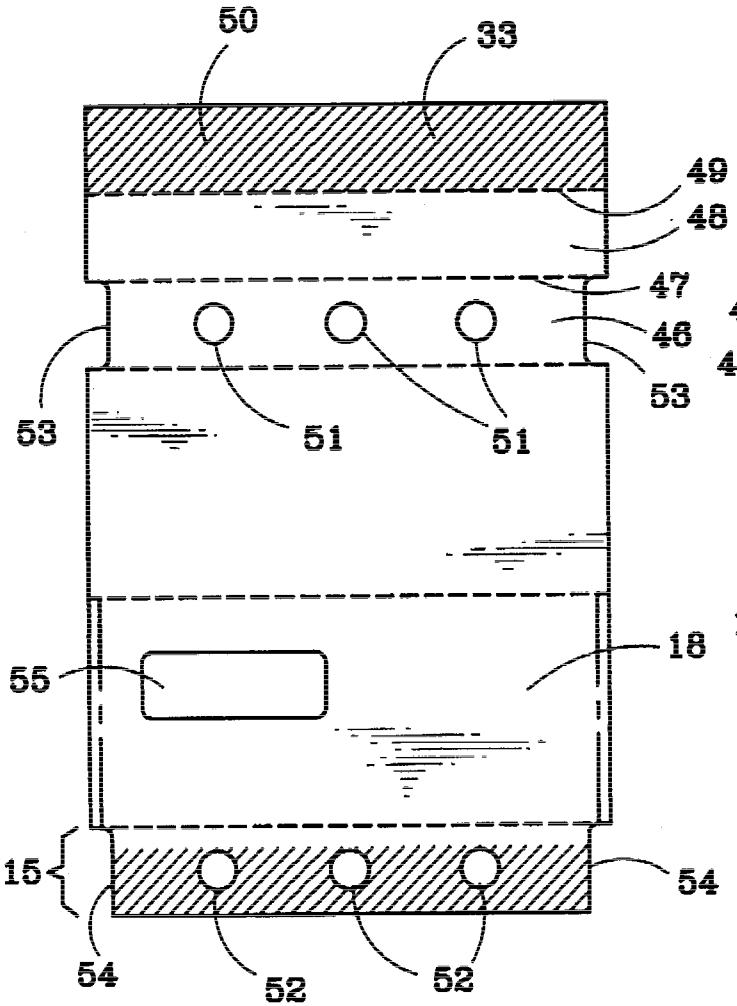
FIG. 9 is an interior view of an unfolded blank form from which a second embodiment of the envelope mailing instrument of the present invention is produced.

A second embodiment that introduces an apertured flap arrangement can be seen in FIGS. 9–11 shown structurally and in FIGS. 12–15 shown configured for mailing. Here the back depending hinged planar element 13 or large back flap is shown segmented into panels that are foldable. Turning to FIG. 9 a first scroll segment 46 is a longitudinal panel section residing on the large back flap 13 and extending from the first separable line of definition 17 or where the large back flap attaches to the back wall of the envelope pocket to an end line 47 that is straight and parallel to the to the first separable line of definition 17. The first scroll segment end line 47 is positioned at approximately one third the vertical dimension of the back flap 13. Two more similar scroll segments chain to the first one to reach the vertically opposite terminal edge 32. A second scroll segment 48 is another longitudinal panel section residing on the large back flap 13 and extending from the first scroll segment end line 47 to a second scroll segment end line 49 that is straight and parallel to the first scroll segment end line 47. The second scroll segment end line is positioned approximately at the second third of the distance between the first separable line of definition and the vertically opposite terminal edge of the back flap 13. A third scroll segment 50 is a final longitudinal panel section residing on the large back flap 13 and extending from the second scroll segment end line 49 to the vertically opposite terminal edge of the back flap 13.

To complete the structural description of the second embodiment, a first set of first scroll segment apertures 51 resides in the large flap near where it hinges to the envelope pocket; to be precise these apertures 51 are holes or through windows in the first scroll segment. A similar set of second apertures 52 resides in the front flap 15 and provides holes or through windows in that flap. Both sets of apertures are cut so that they align when the back and front flaps are extended in planes parallel with the envelope pocket walls. A pair of cut-back sections 53, one cut-back on each end of the first scroll segment, shorten the longitudinal extent of the first scroll segment and along with the aperture sets contribute to the sealing of a folded flap structure the details of which follow. Likewise a second pair of cut-back sections 54, one cut-back on each end of the short flap 15, reside on the smaller flap and shorten the longitudinal extent of the flap. These apertures and cut-back may be in shapes, sizes and locations on the flaps other than those shown in the figures. Their primary function is to facilitate the sealing of both flaps to the body and edge of the envelope. In practice the thickness of the material used to construct the envelope, the type of adhesive, and degree of adhesion required will dictate the size, shape and location of the apertures and cut-backs. The provision of an optional window 55 is shown in FIG. 9, this window or rectangular opening of a conventional arrangement is shown at the expected location of an addressee field on the front facial plane 18. Thus, the primary changes effected to the develop this second embodiment are related to modifications to the flaps. The large back flap 13 is now divided into three segments, and two sets of apertures reside in the both the back flap 13 and the front flap 15 near the fold line where these flaps join the envelope pocket. Similarly corresponding cut-outs on the side ends of the two flaps provide stepped in sections near the pocket structure.

The above described two-flap scroll panel embodiment is assembled similarly to the basic two flap embodiment. As can be seen in FIG. 10, the large flap 13 and the small flap 15 both attach to the open side of the pocket 12. A set of nascent postal fields reside on the front facial plane 18 or front wall; an example of such a field is the window 55. The actual address may appear on an enclosure that is carried in the pocket and is visible through the window 55. The flaps are shown in a non-folded state and the angular arrangement shown illustrates the creases or fold lines which have been previously designated as the first separable line of definition 17 for the back flap and as the second separable line of definition 35 for the front flap where these flaps join the envelope pocket. The angular representations on the large flap 13 in the cross section view show the end line of the first scroll segment 47 and the end line of the second scroll segment 49.

The preceding paragraphs describing the second embodiment have been directed to the structural definition of the envelope parts and the depiction of a constructed envelope in FIGS. 10 & 11 shows the product only in a pre-use condition. When ready for use by a consumer the two flaps would be parallel to each other and in alignment with the back facial plane 14 and the front facial plane 18. Other suitable arrangements have the flaps both folded back, both folded forward or even the front flap 15 tucked inside the envelope pocket. These and other arrangements are to be considered suitable storage arrangements for the flaps prior to use. By use it is meant to make reference to the flow diagram appearing as FIG. 1. The above described structural features of the second embodiment endow this envelope with capability to serve as combined two-way and multi-purpose envelope; the functions of both the carrier envelope and the enclosed envelope shown in the first mailing path 4 are carried out by a single envelope structure. The instructions for special folds and sealing arrangements for the inventive second embodiment follow.

Figure 12:
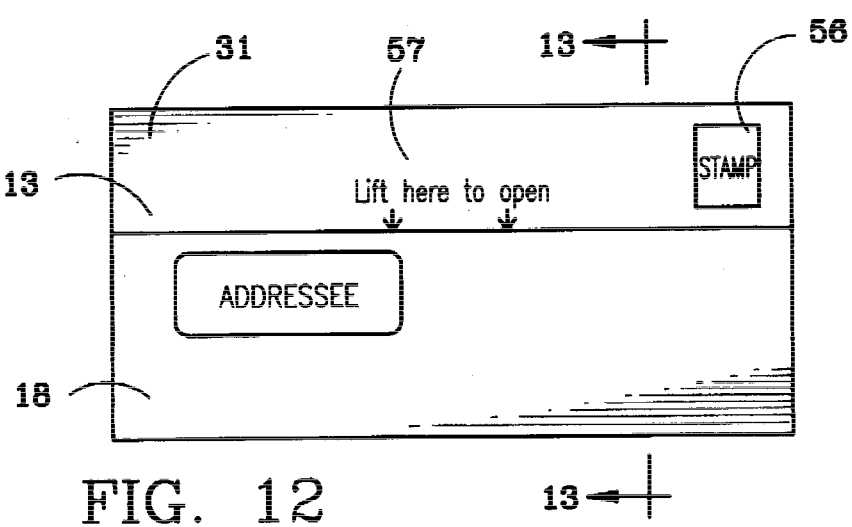
FIG. 12 is a frontal view of the second embodiment of the inventive envelope in a first preferred mailing configuration.

FIGS. 12–15 show two mailing configurations both provided by folds involving the large back flap 13. In FIG. 12 the back flap 13 is folded forward and folded onto itself in a scroll-type fashion so that when adhesively attached to the front facial plane 18 only partial coverage of that plane by the flap structure is accomplished. The folding arrangement presents the first ventral surface 31 of the second scroll segment 48 for carrying a set of third defined nascent postal fields 56. To accomplish the inventive folding arrangement, the whole back flap 13 is hinged forward so as to be positioned in front of the front facial plane 18 or envelope front wall; this initial arrangement can be viewed in FIG. 8. Next the third scroll segment 50, FIG. 13 having an adhesive field 33 on the inside face is folded up and then into a parallel position with the second scroll segment 48. This means that the facial surfaces of the two adjacent end scroll segments are positioned face-to-face; the fold line between these two segments has previously been called out as the end line 49 of the second scroll segment. Next the user repeats the same folding motions to complete the flap preparation for the mailing instrument; thus a second folding step is needed.

Figure 13:
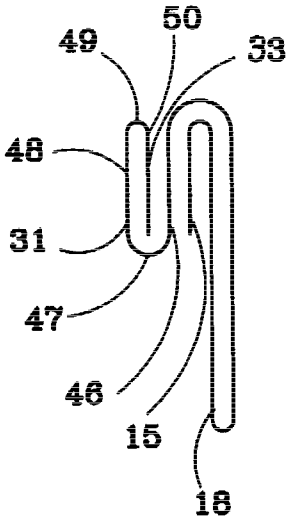
FIG. 13 is a section view taken at location 13—13 of the assembled envelope shown in FIG. 12.
Figure 15:
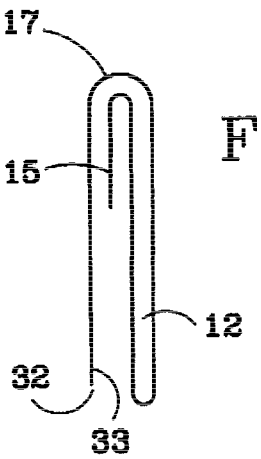
FIG. 15 is a section view taken at location 15—15 of the assembled envelope shown in FIG. 14.
Figure 14:
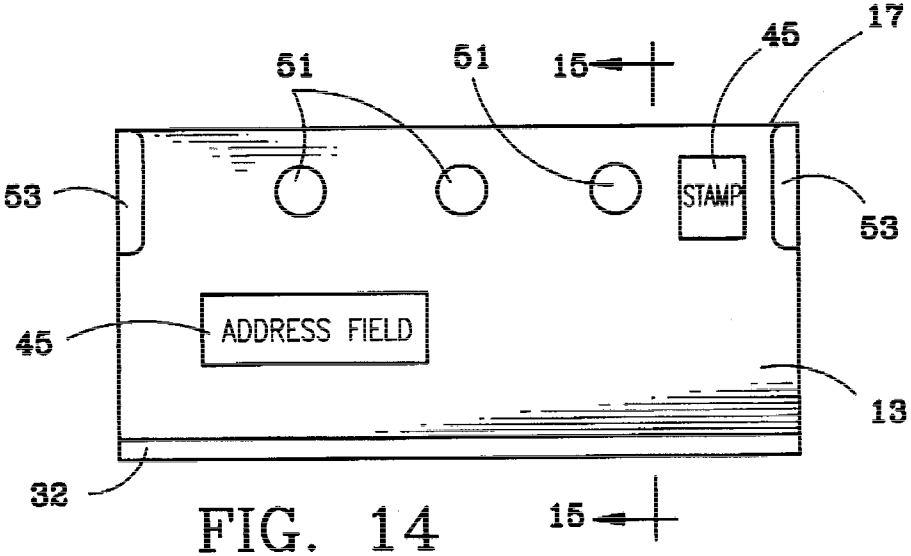
FIG. 14 is a frontal view of the second embodiment of the inventive envelope in a second preferred mailing configuration.
Figure 17:
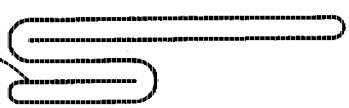
FIG. 17 is a section view taken at location 17—17 of the assembled envelope shown in FIG. 16.
Figure 16:
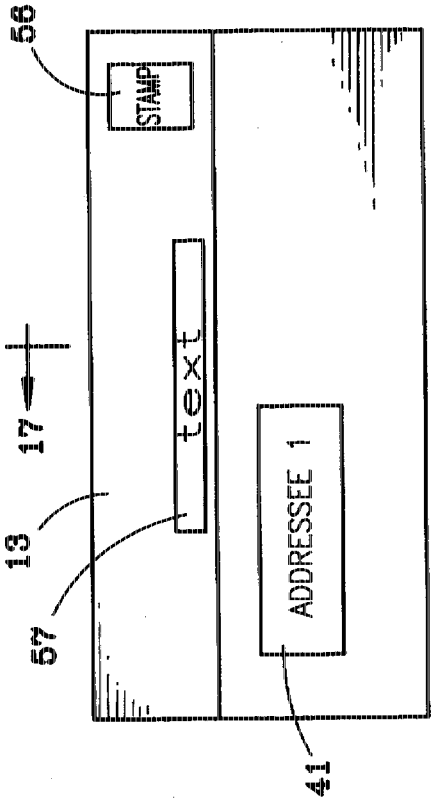
FIG. 16 is a frontal view of the third embodiment of the inventive envelope in a first preferred mailing configuration.
Figure 19:
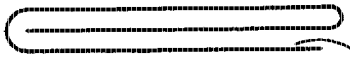
FIG. 19 is a section view taken at location 19—19 of the assembled envelope shown in FIG. 18.
Figure 18:
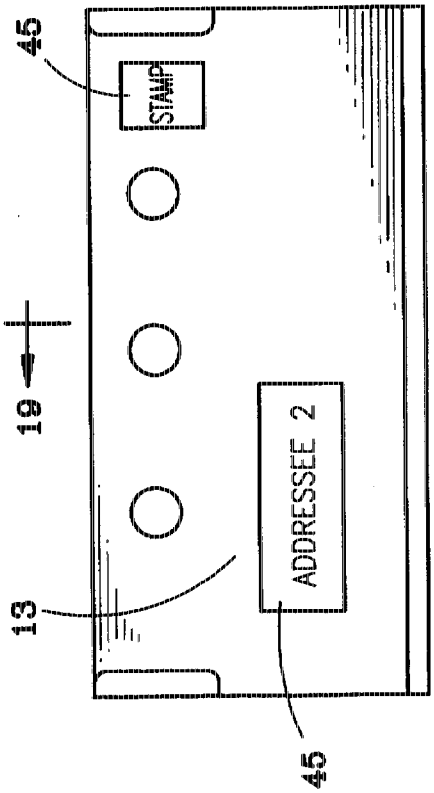
FIG. 18 is a frontal view of the third embodiment of the inventive envelope in a second preferred mailing configuration.

The second folding step for the scroll flap embodiment involves hinging upward as a unit the two-segment pair 48 and 50 previously folded together. The folding continues until this two-segment pair is parallel to the first scroll segment 46; the operative fold line here is the one previously designated as the end line 47 of the first scroll segment. As shown in FIG. 13 the front flap 15 resides in a parked position by being folded forward so as to be parallel with the front wall of the envelope. The alignment of the aperture sets on the two flaps is retained in the folded arrangement shown in FIG. 13 so that the adhesive 33 on the final segment 50 of the back flap when selectively wetted or otherwise activated is presented through the double layer of aperture carriers 15 and 46 for holding the "rolled-up" large rear flap 13 into contact with an upper front region of the envelope pocket. The corresponding cut-back sets 53 and 54 in the two flaps align in a manner similar to the aperture sets to allow full longitudinal end sealing of the adhesive carrying flap end to the face of the envelope pocket. One use of this configuration is for the first mailing path of conventional two-way envelope. A simple instruction 57, FIG. 12, such as "LIFT HERE TO OPEN" may be printed on the outfacing surface of the large folded flap. By limiting the surface area of the adhesive contacting the front face of the envelope pocket through selection of the aperture and cut-back dimensions the folded flap is detachable from the adhesive anchor with minimal degradation of the flap or the envelope pocket surfaces. Since the adhesive area used or activated during this mailing is substantially less than the whole amount of adhesive area available a second mailing can be executed by a second arrangement of the large flap as shown in FIGS. 14 and 15. One way to selectively activate the adhesive for use through the apertures is to use the flap aperture sets as a template for applying moisture to the adhesive. Once this principle of selective activation is understood, other methods of wetting or activating are easily accomplished.

The second folding arrangement for the second embodiment is shown in FIGS. 14 and 15; here the large back flap 13 is used in a non-scrolled condition and simply folded forward like that shown previously in FIGS. 7 and 8. The smaller front flap 15 is retained in the same parked position as previously described. In FIG. 14 the back flap 13 has been folded forward and is ready to be adhesively attached near the terminal edge 32. The fold line 17 between the back flap and the envelope pocket acts as the hinge point for the forward fold which takes the back flap to a position parallel to and covering the front of the envelope pocket. The apertures 51 and cut-backs 53 are visible on the front of the assembled mailing instrument when the second folding arrangement is perfected. As can be seen in FIG. 14 the nascent postal field set 45 resident on the back flap is ready for use in this configuration. Once the user has filled the envelope pocket with contents to be mailed, the back flap 13 is fully sealed using the adhesive strip 33. One use of this configuration is for the second mailing path of a conventional two-way envelope. As can be appreciated from the previous wording used to define the fold line 17 between the back flap and the envelope pocket that line has been termed the separable line of definition; as such a name infers the back flap is removable as initially shown in FIG. 2 to provide an envelope structure that allows the front flap to be used in a conventional manner. With the back flap removed, the entire adhesive band 16 on the small flap 15 may be activated.

The grand solution becomes clear: the recipient of a two-way envelope now has available, in hand, a multi-purpose envelope that has at least two mutually exclusive addressing configurations to allow the envelope to be made into a multi-path mailing instrument. Such a multiple address scheme is clearly available when a window 55 appears in the front wall of the envelope pocket. By way of explanation the addressee shows through the window on the first mailing path; the actual contents on the addressee field reside on an enclosure carried inside the pocket. Once that enclosure is removed the window 55 returns to being a nascent address field. The recipient now has two principal choices of address for the envelope to traverse the postal system again: (1) fold the back flap forward as in FIG. 14, and (2) tear off the big flap, discard it, put a new enclosure inside the envelope pocket positioned to show addressee field contents visible through the window, fold the small front flap, and seal to the back wall of the pocket. Another feature provided by the second embodiment is that an advertisment or other message can be substituted for the nascent postal field set 45 in which situation the large flap 13 is discarded.

FIG. 15 shows the small front flap 15 in the parked position; it is the treatment of this small front flap that gives rise to the third embodiment, one in which the front flap does not appear at all.

The third embodiment, shown in FIGS. 16–19 presents a single flap scroll-panel type structure that can be characterized by the absence of a small front flap. The description of the folds and the placement of the large flap directly parallel the preceding discussion of how the large back flap behaves in the two-flap scroll model referred to as the second embodiment. The advantageous inventive feature here is that the provision of a single scrollable flap eases the manufacturing and fabrication to such an extent as to make this a desirable mailing instrument. If the third embodiment is used as a two-way envelope then the initial addressor or originator of the mailing uses the folded scroll arrangement shown in FIGS. 16 and 17. Here, like the previous scroll and aperture embodiment, the adhesive 33 is selectively wetted or activated to correspond to the apertures and cut-backs so as to reserve sufficient adhesive for a second sealing. This allows breakage of the adhesive bond by the initial recipient so that the rolled-up flap can be unfurled. The initial recipient then may choose to reply using a pre-printed address field set 45 on the outside of the large flap. In the alternate, the third embodiment may arrive at the address of a recipient as an enclosure inside a carrier envelope traversing a first mail path 4, FIG. 1. In this choice of use, the recipient has two address options which have been detailed above; the sealing operation in both options is to wet or activate the whole adhesive band 33, and seal the appropriate surfaces. If this embodiment is used as an enclosure, i.e. as a multi-address envelope, no fold lifting instruction 57 needs to appear.

SUMMARY OF THE MAJOR ADVANTAGES OF THE INVENTION

After reading and understanding the foregoing explanation of the inventive multi-purpose two way envelope or mailing instrument, in conjunction with the drawings, it will be appreciated that several distinct advantages of the subject invention are obtained.

Without attempting to set forth all of the desirable features of the instant multi-purpose envelope, at least some of the major advantages of the invention include a finished mailing instrument having a conventional appearance regardless of the addressing arrangement that the sender chooses to employ. The provision of the multi-path destinations of the mailing instrument is provided by a flap folding arrangement that allows various postage and addressing schemes to be activated or retrieved from a nascent state and for others to be de-activated or returned to a nascent state by coveting such schemes so that they are not available for viewing or scanning by automated equipment.

The present inventive envelope provides a grand solution to both the need to have a one-way multi-directional or multi-destination addressing scheme as well as having novel features that tailor it to the needs of those persons needing a more conventional two-way mailing scheme. Such a solution is provided by a multi-panel folded scroll-type flap arrangement.

The inventive mailing instrument eclipses the known two-way envelopes by providing both a two-way feature and multi-destination feature in the same structure by using a multi-panel flap having a unique scroll folding arrangement that is sealed to the envelope body or to a post card body through a set of apertures in one panel of the scroll-folded flap.

In a preferred embodiment, the back flap 13 has scroll segments 46, 48 and 50, and apertures and cut-backs 51 and 53 that allow a roll-up folding arrangement to cooperate with corresponding apertures and cut-backs 52 and 54 in the front flap 15 to produce a seal and an address field scheme combining fields 41 and 56 on the front wall 18 of the envelope pocket 12 with those on the first ventral surface 31 of the middle or second scroll segment 48. When the seal is broken, the back flap is unfurled and then sealed to the lower front of the pocket face 18 thus bringing up another postal field set 45. In the alternate, after the back flap is unfurled, it is torn off and discarded thus making available another postal field set 41 on the front wall 18. The envelope is then sealed by the front flap 15.

In describing the invention, reference has been made to a preferred embodiment of in illustrative advantages of the invention. Those skilled in the art and familiar with the instant disclosure of the subject invention, may recognize additions, deletions, modifications, substitutions, and other changes which will fall within the purview of the subject invention and following claims.

What is claimed is:

1. A multipurpose mailing instrument comprising:

a front facial plane defined by a rectangle having a longitudinal dimension and a vertical dimension;

a back facial plane coextensive with and underlying said front facial plane along corresponding longitudinal and vertical dimensions;

front facial plane and back facial plane terminal edges defined by said longitudinal dimensions and said vertical dimensions;

said front facial plane and said back facial plane each having inner and outer surfaces, said inner surfaces being positioned in face-to-face relationship;

a set of first defined nascent postal fields residing on said outer surface of said front facial plane;

a back depending hinged planar element joined to said back facial plane along one of said terminal edges of said back facial plane;

a back depending hinged planar element terminal edge specified by a straight line residing on said back depending hinged planar element;

a first separable line of definition residing between said back depending hinged planar element and said back facial plane at the line defined by said back planar depending hinged planar element terminal edge and said one of terminal edges of said back facial plane;

a first facial surface on the outer face of said back depending hinged planar element;

said first facial surface being positionable to an approximately coplanar position with said outer surface of said front facial plane and being of substantially the same dimension as said outer surface of said front facial plane;

said first facial surface completely covering all of said set of first defined nascent postal fields on said outer surface of said front facial plane;

a first ventral surface on an inner face of said back depending hinged planar element;

a set of second defined nascent postal fields residing on said first facial surface;

a first scroll segment defined as a longitudinal panel section on said back depending hinged planar element, said first scroll segment extending from said first separable line of definition to an end defined by a straight line parallel to said first separable line of definition and positioned at approximately one third the vertical dimension of said back depending hinged planar element;

a second scroll segment defined as a longitudinal panel section on said back depending hinged planar element and residing in a second third of the vertical dimension of said back depending hinged planar element;

a third scroll segment defined as a longitudinal panel section on said back depending hinged planar element and residing on a final third of the vertical dimension of said back depending hinged planar element;

a first adhesive field on said first ventral surface of said back depending hinged planar element, said first adhesive field positioned on said third scroll segment; and a set of first segment cut-back sections residing on said first scroll segment.

2. A multipurpose mailing instrument as defined in claim 1 further comprising:

a set of first segment aperatures residing on said first scroll segment.

3. A multipurpose mailing instrument as defined in claim 1 further comprising:

a front depending hinged planar element joined to said front facial plane along one of said terminal edges of said front facial plane;

a front planar depending hinged element terminal edge specified by a straight line residing on said front depending hinged planar element;

a second facial surface on the outer face of said front depending hinged planar element;

said second facial surface being positionable to an approximately coplanar position with said outer surface of said back facial plane;

a second ventral surface on the inner face of said front depending hinged planar element;

a second separable line of definition residing between said front depending hinged planar element and said front facial plane at the line defined by said front depending hinged planar element terminal edge and one of said terminal edges of said front facial plane;

said front depending hinged planar element and said back depending hinged planar element being joined to said front facial plane and to said back facial plane respectively along corresponding terminal edges a second adhesive field on said second ventral surface of said front depending hinged planar element; and a set of second cut-back sections residing on said front depending hinged planar element, said set of second cut-back sections aligned with said set of first segment cut-back sections.

4. A multipurpose mailing instrument as defined in claim 3 further comprising:

a set of second apertures residing on said front depending hinged planar element, said set of second apertures aligned with said set of first segment apertures.

* * * * *